US005931471A

United States Patent [19]

Bonito

[11] Patent Number: 5,931,471

[45] Date of Patent: Aug. 3, 1999

[54] CATALINA DICE

[75] Inventor: John P. Bonito, Las Vegas, Nev.

[73] Assignee: Catalina Dice, L.L.C., Las Vegas, Nev.

[21] Appl. No.: 08/960,727

[22] Filed: Oct. 30, 1997

Related U.S. Application Data

[63] Continuation-in-part of application No. 08/739,591, Oct. 30, 1996, abandoned

[60] Provisional application No. 60/006,821, Nov. 16, 1995.

[51] Int. Cl.[6] ..... A63F 3/00

[52] U.S. Cl. ..... 273/274; 273/146

[58] Field of Search ..... 273/274, 292, 273/146

[56] References Cited

U.S. PATENT DOCUMENTS

| | | | |
|---|---|---|---|
| 4,247,114 | 1/1981 | Carroll | 273/274 |
| 5,308,081 | 5/1994 | Bartle | 273/274 |
| 5,350,175 | 9/1994 | DiLullo et al. . | |
| 5,395,119 | 3/1995 | Jacob et al. | 273/274 |
| 5,397,128 | 3/1995 | Hesse et al. | 273/292 |
| 5,490,670 | 2/1996 | Hobert . | |
| 5,513,850 | 5/1996 | Vancura . | |
| 5,785,596 | 7/1998 | Hobert | 273/274 |
| 5,820,128 | 10/1998 | Brunelle | 273/292 |
| 5,829,748 | 11/1998 | Moore, Jr. | 273/274 |

*Primary Examiner*—William M. Pierce
*Attorney, Agent, or Firm*—John Edward Roethel

[57] ABSTRACT

The conventional manner of play of Craps is modified by removing some of the wagers, adding other wagers and modifying still other wagers that are associated with conventional Craps. On the Come out roll, the player has the option of making an Insurance Wager to protect against a 2, 3 or 12 being rolled. The Insurance Wager pays 6 for 1 and is still up (a push bet) if a 7 or 11 is rolled. The traditional Field Bet is replace by a Player's Bet. The winning numbers on the Player's Bet are 2, 3, 4, 10, 11 and 12—11 pays one-to-one odds; 2, 3, 4 and 10 pay two-to-one odds; and 12 pays three-to-one odds. After a point is established on the Come out roll, a player may make a Money Line Hard Way wager which is only available when the point is 4, 6, 8 or 10. A hardway 4 or 10 pays 8 for 1 and a hardway 6 and 8 pays 10 for 1. Also, after the point is established, a player may Surrender his money line wager. When a surrender occurs, the player receives back one-half of his original money line wager and his money line wager is deactivated. A player may make a Catalina Doubles wager at any time. If a double is rolled back to back (on successive rolls), the player is paid 20 to 1. If the same double is rolled back to back, the player is paid 100 to 1.

10 Claims, 1 Drawing Sheet

CATALINA DICE

CROSS-REFERENCE TO RELATED APPLICATIONS

This application is a Continuation-in-Part of application Ser. No. 08/739,591, filed Oct. 30, 1996, now abandoned.

This Application claims benefit of Provisional Application No. 60/006,821 filed Nov. 16, 1995.

BACKGROUND OF THE INVENTION

This invention relates to a dice game, and more particularly to a variation of standard craps.

Craps has been a staple dice game in gaming establishments for many years. Craps is played using two standard six-sided dice. A player initially makes a wager on the first roll of the dice. On the first roll, three possibilities are present—a roll of 7 or 11 is a winning roll, a roll of 2, 3 or 12 is a losing roll and a roll of any other number establishes a point to be made. If a point is made, the player continues to roll until either the point is rolled (and the player wins) or a 7 is rolled and the player loses.

In the casino version of craps, after a point is established, a player may make another wager such as taking odds on the point. The player may also make a COME bet which is treated like the initial roll to determine winning rolls, losing rolls or rolls that establish another point to be made.

While the normal rolling of the dice is occurring, many other wagers can be made. Typical of these bets are"place bets" and the"hard ways bets". These bets stay in action until an event occurs or the player takes the bet down.

Other bets are only in action for one roll. Typical of these bets are"field bets". The determination of winning or losing on these bets is made on the next roll only.

Traditionally, field bets include seven numbers out of the possible eleven numbers that can be rolled with a pair of dice. Field bets usually are bets that the numbers 2, 3, 4, 9, 10 11 and 12 will be rolled on that roll of the dice. It is customary in Nevada casinos that when a 12 is rolled, the payout is three-to-one odds; when a 2 is rolled, the payout is two-to-one odds; and all other winning field bet rolls pay one-to-one odds. Out of the 36 possible combinations (or"ways") that two dice that can be rolled, a field number can be rolled 16 ways. If a bettor wagers one unit over the entire 36 number cycle (36 total units wagered), the bettor will lose 20 times and the bettor will win 16 times.

For a complete description of Craps, reference is made to *Scarne's New Complete Guide to Gambling*, pages 259–336, the disclosure of which is incorporated herein. See also, *Scarne on Dice*, pages 64–65 for a discussion on how to figure the odds at Craps, pages 98–99 for an explanation of field bets and page 461 for a definition of a field bet, all of which are incorporated herein by reference.

Craps is said to be on the decline in that younger gamblers find the game difficult to understand. A conventional Craps game operated in a gaming establishment also requires four persons to deal the game.

There is a need in the gaming business to provide a less complicated dice game, a more interchangeable format and one that can be dealt using a single dealer so as to minimize the labor and overhead normally associated with operating a conventional Craps game.

It is an object of the present invention to provide a variation to conventional Craps that can be dealt by a single person while at the same time maintaining the thrill and excitement of a dice game.

It is a feature of the present invention to modify the method of play of conventional Craps by eliminating some of the wagers traditionally available and adding other wagers to create a method of play that is much easier to deal and supervise.

It is an advantage of the present invention that the expense and overhead involved in operating a conventional Craps game in reduced. It is a further advantage of the present invention that the speed and excitement of a dice game are retained which will maintain the interest of the player.

Other objects, features and advantages of the present invention will become apparent from a consideration of the following detailed description.

SUMMARY OF THE INVENTION

The conventional manner of play of Craps is modified by removing some of the wagers, adding other wagers and modifying still other wagers that are associated with conventional Craps.

On the Come out roll, the player has the option of making an Insurance Wager to protect against a 2, 3 or 12 being rolled. The Insurance Wager pays 6 for 1 and is still up (a push bet) if a 7 or 11 is rolled.

The traditional Field Bet is replace by a Player's Bet. The winning numbers on the Player's Bet are 2, 3, 4, 10, 11 and 12—11 pays one-to-one odds; 2, 3, 4 and 10 pay two-to-one odds; and 12 pays three-to-one odds.

After a point is established on the Come out roll, a player may make a Money Line Hard Way wager. This wager is only available when the point is 4, 6, 8 or 10. If the active point number is made the hardway (by the dice showing a pair adding up to the point), the player wins odds on his wager. A hardway 4 or 10 pays 8 for 1 and a hardway 6 and 8 pays 10 for 1.

Also, after the point is established, a player may Surrender his money line wager. When a surrender occurs, the player receives back one-half of his original money line wager and then his money line wager is deactivated.

A player may make a Catalina Doubles wager at any time. If a double is rolled back to back (on successive rolls), the player is paid a first predetermined amount, such 20 to 1 odds. If the same double is rolled back to back, the player is paid a second predetermined amount, such as 100 to 1 odds.

DETAILED DESCRIPTION OF THE PREFERRED EMBODIMENTS

Figure 1:
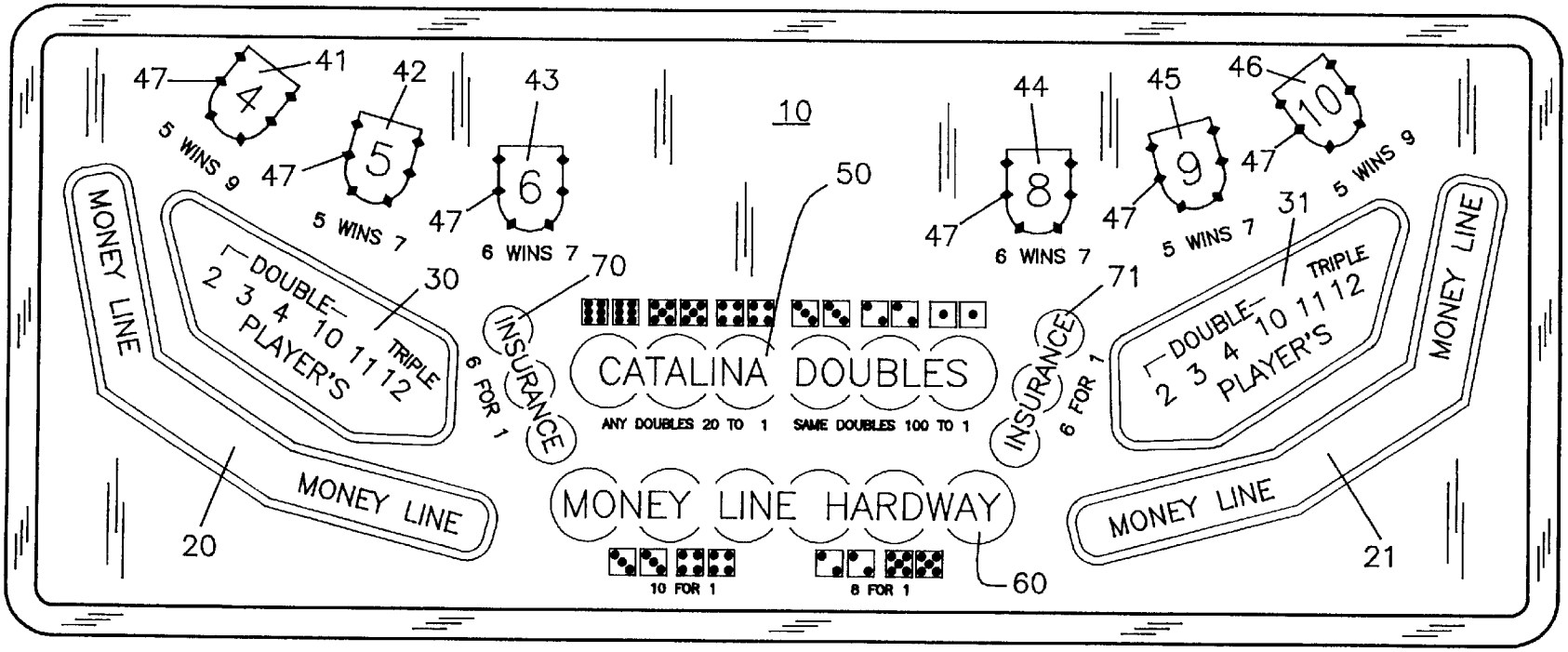
FIG. 1 shows a gaming table layout for practicing the method of the present invention.

The method of the present invention is practiced using two conventional six-sided dice, the opposite sides of which equal seven. FIG. 1 shows a representation of a gaming table layout 10 used to practice the method of the present invention. The gaming table layout 10 is designed to be used by up to six players and can be operated by a single casino employee who can monitor the play of the game, collect losing wagers and pay winning wagers. Each wagering location on the gaming table layout 10 is large enough to accommodate the wagers from six separate players. The conventional method of play of Craps is used, modified as follows:

Money Line Wagers: On the first (Come out)roll, the player may bet the Money Line which pays even money.

Two separate Money Line wager locations 20 and 21 are provided so that the three players on the left side of the gaming table layout 10 can use the left side Money Line wager location 20 and the three players on the right side of the gaming table layout 10 can use the right side Money Line wager location 21. Each player makes a Money Line wager by placing a wagering token (casino chip, gaming token or cash) at his associated position adjacent the closest Money Line wager location 20 or 21. One of the players is designated as the Shooter (the person who rolls the dice) and that player rolls the two dice which come to rest on the gaming table layout. Alternatively, other means may be used to designate the roll of the dice, such as a mechanical dice popper or agitator or even electronic devices showing the roll of two dice. The top side of each die when it comes to rest displays a number of pips and the two dice added together result in the number rolled by the Shooter. A first roll of 7 or 11 is an instant winner, a first roll of 2, 3 or 12 is an instant loser. A first roll of 4, 5, 6, 8, 9 or 10 establishes the Money Line Point. If a Money Line point is established, the Shooter continues to roll until he rolls the Money Line point or a 7. If the Shooter rolls the Money Line Point before rolling a 7, each player also wins. If a 7 is rolled before the Money Line point is rolled, each player loses his Money Line Wager.

After a Money Line Point is established, each player may make an Odds wager by placing a wagering token directly behind the player's Money Line Wager. This wager is active while the Shooter rolls to either roll the Money Line point or roll a 7. If the Money Line Point is 4 or 10, every $1 wagered wins $2 whenever the Shooter rolls a 4 or 10 before rolling a 7. If the Money Line Point is 5 or 9, every $2 wagered wins $3 whenever the Shooter rolls a 5 or 9 before rolling a 7. If the Money Line Point is 6 or 8, every $5 wagered wins $6 whenever the Shooter rolls a 6 or 8 before rolling a 7. This Odds wager may be taken down (deactivated) by the player at any time without losing any of the Odds wager.

A Surrender Option is also available. After the Money Line Point is established, the player may surrender his Money Line wager and recover half of his original bet. The player effects this Surrender Option by orally notifying the dealer who then returns to the player half of the player's Money Line wager.

The Player's Wager: A Player's Wager may be made before any roll. Two separate Player Wager locations 30 and 31 are provided so that the three players on the left side of the gaming table layout 10 can use the left side Player Wager location 30 and the three players on the right side of the gaming table layout 10 can use the right side Player Wager location 31. Each player makes a Player Wager by placing a wagering token (casino chip, gaming token or cash) at his associated position adjacent the closest Player Wager location 30 or 31. If a Player's Wager is made and the Shooter rolls one of the winning Player Wager numbers, the player wins even money (one-to-one odds)on a roll of 11, double (two-to-one odds) on a roll of 2, 3, 4, and 10 and triple (three-to-one odds) on a roll of 12. All other rolls are losing rolls. Each Player Wager is in effect for one roll of the dice. The Player's Wager replaces both the "Field Bet" wager and "Come" wager used in conventional Craps.

The end result is that the Player's Wager results in new winning combinations and new strategy being introduced into a dice game. The Player's Wager provides 12 different winning ways out of the 36 possible dice combinations that can be rolled. At the same time, the dealability of the game is simplified since the Come bets have been eliminated. The favorable odds to the player are retained so that the popularity of the method of play is kept intact, while at the same time introducing completely new wagering strategy and results that cannot be obtained in a conventional Craps game. For example, in the method of play of the present invention, the bettor can play a combination of a Money Line bet and a Player Wager of equal amounts together on the Come Out roll with the hope that the Ace-Deuce combination or any 4 number combination or any 10 number combination will show on that roll. This wagering strategy is completely unavailable in a conventional Craps game.

Place Bets: After a Money Line Point has been established, players may bet directly on any of the other points by making what is called a Place Bet. As shown in FIG. 1, the gaming table layout is provided with Place Bet wagering locations 41, 42, 43, 44, 45 and 46. In the preferred embodiment of the present invention, each location is a geometric shape (for example, an elongated semicircle, although other geometric shapes can be used) and each geometric shape is provided with markings 47 indicating a location for a player to position his Place Bet wager. Each geometric shape is provided with six markings 47 around the semicircle corresponding to the player's physical location around the gaming table layout 10. In order to make a Place Bet, a player places a wagering token on the marking 47 corresponding to the player's physical location at the gaming table 10 and corresponding to the Place Bet number upon which the player wishes to wager. For example, if the player wishes to make a Place Bet on the number 4, the player places a wagering token on the appropriate marking 47 on Place Bet wagering location 41.

Each Place Bet remains active until a 7 is rolled (unless the Place Bet is taken down by the player), at which time all active Place Bets are lost. Each time one of the Place Bet numbers is rolled by the Shooter, each player having a Place Bet wager on that number wins. The odds paid on Place Bets depend on the number being bet. On Place Bet numbers 4 or 10, every $5 wins $9. On Place Bet numbers 5 or 9, every $5 wins $7. On Place Bet numbers 6 or 8, every $6 wins $7. Place Bets are always off on the"Come Out" roll.

Additional Optional Bets: The method of the present invention also provides for a number of optional bets that may be made during the course of play of the game.

Catalina Doubles: This is a two roll bet that can be made at any time. Each player may make a Catalina Doubles wager by placing a wagering token in the Catalina Doubles wagering location 50 at the appropriate segment representing that player's physical location at the gaming table layout 10. As shown in FIG. 1, the Catalina Doubles wagering location 50 is displayed as six interlocking circles (one for each player), although other shapes or displays can be used.

On the first roll, the dice must land on any double (double 1's, 2's, 3's, 4's, 5's or 6's.) or the wager is lost. On the next roll after a first roll double, if any double is rolled, this bet pays a first predetermined amount. Any suitable payout can be made for this event, although the preferred embodiment of the present invention is that the first predetermined amount is 20-to-1 odds. If the same double happens to be rolled back to back on successive rolls, this bet pays a second predetermined amount. Any suitable payout can also be made for this event, although the preferred embodiment of the present invention is that the second predetermined amount is 100-to-1 odds.

Money Line Hard Way: This wager becomes active only when the Money Line point to be made is 4, 6, 8 or 10. Each player may make a Money Line Hard Way wager by placing a wagering token in the Money Line Hard Way wagering location 60 at the appropriate segment representing that player's physical location at the gaming table layout 10. As shown in FIG. 1, the Money Line Hard Way wagering location 60 is displayed as six interlocking circles (one for each player), although other shapes or displays can be used.

Once a Money Line point of either 4, 6, 8 or 10 has been established, a player may make a Money Line Hard Way wager that the particular Money Line point will be made by a matching pair on the dice. A Money Line point of 4 (made with two 2's) or 10 (made with two 5's) pays 8 for 1 odds. A Money Line point of 6 (made with two 3's) or 8 (made with two 4's) pays 10 for 1 odds. This wager is lost when the Money Line point is made by a non-hardway combination or when the Money Line point itself is lost by the Shooter rolling a 7.

Insurance: This bet can only be made on the Come out roll. Two separate Insurance Wager locations 70 and 71 are provided so that the three players on the left side of the gaming table layout 10 can use the left side Insurance Wager location 70 and the three players on the right side of the gaming table layout 10 can use the right side Insurance Wager location 71. Each player makes a Insurance Wager by placing a wagering token (casino chip, gaming token or cash) at his associated position adjacent the closest Insurance Wager location 70 or 71. As shown in FIG. 1, each Insurance Wager location 70 and 71 is displayed as three interlocking circles (one for each player on that side of the gaming table layout 10), although other shapes or displays can be used.

When a player makes an Insurance Wager, the player is wagering to protect against a 2, 3 or 12 being rolled on the Come out roll. The Insurance Wager pays 6 for 1 if a 2, 3 or 12 is rolled on the Come out roll, this bet is still up (a push bet) if a 7 or 11 is rolled and this bet is lost if any other number is rolled on the Come out roll.

While the invention has been illustrated with respect to several specific embodiments thereof, these embodiments should be considered as illustrative rather than limiting. For example, The payoff odds that are described are illustrative only and can be modified as desired to adjust the hold percentage (up or down) of the method of the present invention Various modifications and additions may be made and will be apparent to those skilled in the art.

What is claimed is:

1. A method of playing a dice game using a pair of conventional six-sided dice which are rolled by a shooter consisting essentially of the following wagers and the gaming steps:

a) a player being provided with the opportunity to make a Money Line Wager that pays even money odds;

b) the player being provided with the opportunity to make an Insurance Wager that pays six for one odds;

c) the shooter rolling the dice as a Come Out roll;

d) if the shooter rolls a 7 or an 11 on the Come Out roll, the Money Line Wager wins; if the shooter rolls a 2, 3 or 12 on the Come Out roll, the Money Line Wager loses; and if the shooter rolls a 4, 5, 6, 8, 9 or 10 on the Come Out roll, a Point is established and the Money Line Wager remains in play, e) if the shooter rolls a 2, 3 or 12 on the Come Out roll, the Insurance Wager wins; if the shooter rolls a 7 or 11 on the Come Out roll, the Insurance Wager is a push and if the shooter rolls any other number of the Come Out roll, the Insurance Wager is a loser;

f) after a Point is established, a player being provided with the opportunity of surrendering his Money Line Wager and, if the player so surrenders, the player loses half of his original Money Line Wager;

g) after a Point has been established, a player being provided with the opportunity to make an Odds wager that the shooter will roll the Point before rolling a 7;

h) the shooter begins to roll the dice to attempt to roll the Point:

1) if the Point is 4 or 10, the Odds wager pays two to one if the shooter rolls the Point before the shooter rolls a 7;

2) if the Point is 5 or 9, the Odds wager pays three to two if the shooter rolls the Point before the shooter rolls a 7;

3) if the Point is 6 or 8, the Odds wager pays six to five if the shooter rolls the Point before the shooter rolls a 7; and 4) all Odds wagers are lost if the shooter rolls a 7 before rolling the Point;

i) after a Point has been established, a player being provided with the opportunity to make one or more Place Bet Wagers that the shooter will roll a 4, 5, 6, 8, 9 or 10 before rolling a 7;

1) if the shooter rolls a 4 or 10, the Place Bet Wager pays nine to five;

2) if the shooter rolls a 5 or 9, the Place Bet Wager pays seven to five;

3) if the shooter rolls a 6 or 8, the Place Bet Wager pays seven to six;

4) all Place Bet Wagers are lost if the shooter rolls a 7; and 5) all Place Bet Wagers are a push if the shooter rolls any other number;

j) after a Point has been established and the Point is either 4, 6, 8 or 10, a player being provided with the opportunity to make a Money Line Hard Way wager that the Point will be made by a matching pair of dice;

1) if the Point is made by a matching pair of dice, the Money Line Hard Way wager pays eight for one odds if the Point is 4 or 10;

2) if the Point is made by a matching pair of dice, the Money Line Hard Way pays ten for one odds if the Point is 6 or 8; and 3) the Money Line Hard Way wager is lost if the Point is made by a non-hard way dice combination or if a 7 is rolled;

k) prior to any roll of the dice, the player being provided with the opportunity to make a Player Wager that pays three for one odds if a 12 is rolled, that pays two for one odds if a 2, 3, 4 or 10 is rolled and that pays even money odds if an 11 is rolled;

1) if the shooter rolls a 2, 3, 4, 10, 11 or 12 on the roll of the dice, the Player Wager wins; and 2) if the shooter rolls any other number on the roll of the dice, the Player Wager loses; and l) prior to any roll of the dice, a player being provided with the opportunity to make a Catalina Doubles wager that the next two consecutive rolls of the dice will both be rolls of doubles;

1) if a first roll and a second consecutive roll of the dice are both doubles, the Catalina Doubles wager pays a first predetermined amount;

2) if a first roll and a second consecutive roll of the dice are the same doubles, the Catalina Doubles wager pays a second predetermined amount; and 3) if either the first roll or the second consecutive roll of the dice are not doubles, then the Catalina Doubles wager is lost.

2. The method of claim 1 in which the first predetermined amount is twenty-to-one odds.

3. The method of claim 1 in which the second predetermined amount is one hundred-to-one odds.

4. A method of playing a dice game using a pair of conventional six-sided dice which are rolled by a shooter comprising:

a) a player making an Insurance Wager that pays six for one odds;

b) the shooter rolling the dice and if the shooter rolls a 2, 3 or 12 on the roll of the dice, the Insurance Wager wins; if the shooter rolls a 7 or 11 on the roll of the dice, the Insurance Wager is a push; and if the shooter rolls any other number on the roll of the dice, the Insurance Wager loses.

5. A method of playing a dice game using a pair of conventional six-sided dice which are rolled by a shooter, which game does not offer a conventional Field Bet wager from conventional Craps comprising:

a) the player making a Player Wager that pays three for one odds if a 12 is rolled, that pays two for one odds if a 2, 3, 4 or 10 is rolled and that pays even money odds if an 11 is rolled;

b) the shooter rolling the dice and if the shooter rolls a 2, 3, 4, 10, 11 or 12 on the roll of the dice, the Player Wager wins and if the shooter rolls any other number on the roll of the dice, the Player Wager loses.

6. The method of claim 5 further comprising:

a) a player making a Money Line Wager that pays even money odds;

b) the shooter rolling the dice as a Come Out roll;

c) if the shooter rolls a 7 or an 11 on the Come Out roll, the Money Line Wager wins; if the shooter rolls a 2, 3 or 12 on the Come Out roll, the Money Line Wager loses; and if the shooter rolls a 4, 5, 6, 8, 9 or 10 on the Come Out roll, a Point is established and the Money Line Wager remains in play; and d) after a Point is established, a player being provided with the opportunity of surrendering his Money Line Wager and, if the player so surrenders, the player loses half of his original Money Line Wager.

7. A method of playing a dice game using a pair of conventional six-sided dice which are rolled by a shooter comprising:

a) a shooter making a first roll of the dice to establish a Point of either 4, 6, 8 or 10;

b) after the Point of either 4, 6 8 or 10 has been established, a player making a Money Line Hard Way wager that the Point will be made by a matching pair of dice;

c) the shooter rolling the dice and if the Point is made by a matching pair of dice, the Money Line Hard Way wager pays eight for one odds if the Point is 4 or 10;

d) the shooter rolling the dice and if the Point is made by a matching pair of dice, the Money Line Hard Way wager pays ten for one odds if the Point is 6 or 8; and e) the shooter rolling the dice and the Money Line Hard Way wager is lost if the Point is made by a non-matching dice combination or if a 7 is rolled.

8. A method of playing a dice game using a pair of conventional six-sided dice which are rolled by a shooter comprising:

a) prior to any roll of the dice, a player making a Catalina Doubles wager that the next two rolls of the dice will both be rolls of doubles;

b) the shooter making two rolls of the dice;

1) if a first roll and a second consecutive roll of the dice are both doubles, the Catalina Doubles wager pays a first predetermined amount;

2) if a first roll and a second consecutive roll of the dice are the same doubles, the Catalina Doubles wager pays a second predetermined amount; and 3) if either the first roll or the second consecutive roll of the dice are not doubles, then the Catalina Doubles wager is lost.

9. The method of claim 8 in which the first predetermined amount is twenty-to-one odds.

10. The method of claim 8 in which the second predetermined amount is one hundred-to-one odds.

* * * * *